United States Patent [19]

Williams

[11] Patent Number: 5,051,180

[45] Date of Patent: Sep. 24, 1991

[54] DEVICE FOR REMOVING MATERIAL FROM THE FREE SURFACE OF A BODY OF LIQUID USING UNEQUAL LENGTH LINKAGES

[75] Inventor: Geoffrey H. Williams, Tetbury, United Kingdom

[73] Assignee: Sheppard Ingot Castings Machines Limited, United Kingdom

[21] Appl. No.: 347,098

[22] Filed: May 3, 1989

[30] Foreign Application Priority Data

May 10, 1988 [GB] United Kingdom ..... 8811066

[51] Int. Cl.[5] ..... B66C 23/04

[52] U.S. Cl. ..... 210/241; 266/228; 414/718; 414/749; 414/917

[58] Field of Search ..... 37/71, 118 R; 210/523, 210/525, 527, 528, 530, 776, 237, 241; 414/719, 685, 686, 917, 718, 749; 266/228

[56] References Cited

U.S. PATENT DOCUMENTS

| | | | |
|---|---|---|---|
| 2,006,825 | 7/1935 | Downes | 210/527 |
| 2,431,288 | 11/1947 | Weiler | 266/228 |
| 3,260,386 | 7/1966 | Engstrom | 37/118 R |
| 3,326,379 | 6/1967 | Caddick | 210/523 |
| 3,659,833 | 5/1972 | Grant | 266/228 |
| 3,868,323 | 2/1975 | Fux | 210/527 |
| 3,876,101 | 4/1975 | Stedman | 414/917 |
| 3,913,756 | 10/1975 | Barron et al. | 414/749 |
| 3,941,360 | 3/1976 | Blank | 266/228 |
| 4,329,797 | 5/1982 | Shumaker | 37/118 R |
| 4,486,309 | 12/1984 | Krodel | 210/525 |

FOREIGN PATENT DOCUMENTS

| | | | |
|---|---|---|---|
| 332254 | 1/1921 | Fed. Rep. of Germany | 266/228 |
| 2392929 | 2/1979 | France | 414/685 |
| 2485383 | 12/1981 | France | 210/525 |
| 57-168763A | 1/1983 | Japan | 414/749 |
| 0616375 | 7/1978 | U.S.S.R. | 37/118 R |
| 1115941 | 9/1984 | U.S.S.R. | 414/917 |
| 1284670 | 1/1987 | U.S.S.R. | 266/228 |
| 291614 | 6/1928 | United Kingdom | 266/228 |

*Primary Examiner*—Robert A. Dawson
*Assistant Examiner*—Joseph Drodge
*Attorney, Agent, or Firm*—Welsh & Katz, Ltd.

[57] ABSTRACT

A device for removing material from the free surface of a contained body of liquid comprises a scoop supported from a fixed member by two links that carry a substantially horizontal arm on which the scoop is mounted so as to be rotatable about the axis of the arm. The connections of the links to the fixed member and to the arm are pivotal connections at the four corners of a quadrilateral. First actuating means pivots the link about its connection to the fixed member thereby to move the arm to and fro substantially in a horizontal plane. Second actuating means rotates the scoop about the axis of the arm.

11 Claims, 2 Drawing Sheets

FIG. 1.
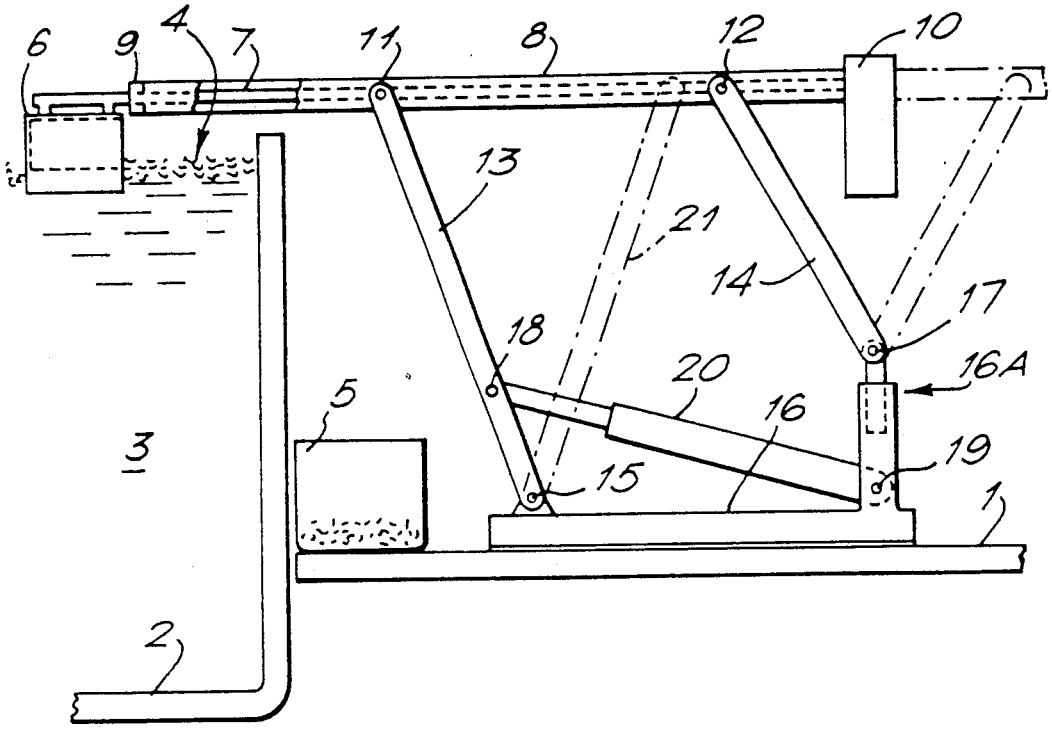
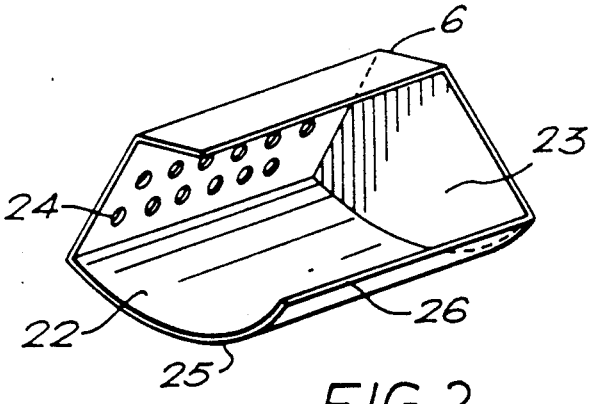
FIG. 2.

DEVICE FOR REMOVING MATERIAL FROM THE FREE SURFACE OF A BODY OF LIQUID USING UNEQUAL LENGTH LINKAGES

BACKGROUND OF THE INVENTION

Field of the Invention

This invention relates to devices for removing material that is close to the free surface of a contained body of liquid, for example, unwanted matter floating on a liquid.

In many cases such devices are required to work in hostile environments, for example at high temperature and/or in a corrosive atmosphere. Under these conditions it is desirable to use particular mechanical elements, for example, simple rotating joints. However, the action of sweeping across a liquid surface requires movements of a linear nature, preferably in one or more planes.

SUMMARY OF THE INVENTION

According to the present invention there is provided a device for removing material from the free surface of a contained body of liquid, the device comprising a scoop supported from a fixed member by two links that carry a substantially horizontal arm on which the scoop is mounted so as to be rotatable about the axis of the arm, the connections of the links to the fixed member and to the arm being pivotal connections at the four corners of a quadrilateral; first actuating means connected for pivoting a first of the links about its connection to the fixed member thereby to move the arm to and fro substantially in a horizontal plane; and second actuating means for rotating the scoop about the axis of the arm. This device combines the use of simple joints with required geometric characteristics.

BRIEF DESCRIPTION OF THE DRAWINGS

For a better understanding of the invention and to show how the same may be carried into effect, reference will now be made, by way of example, to the accompanying drawings, in which:

FIG. 1 is a schematic side view of a device for removing material from the free surface of a contained body of liquid;

FIG. 2 is a perspective view, on a larger scale, of a part of the device; and

DESCRIPTION OF THE PREFERRED EMBODIMENTS

Figure 3:
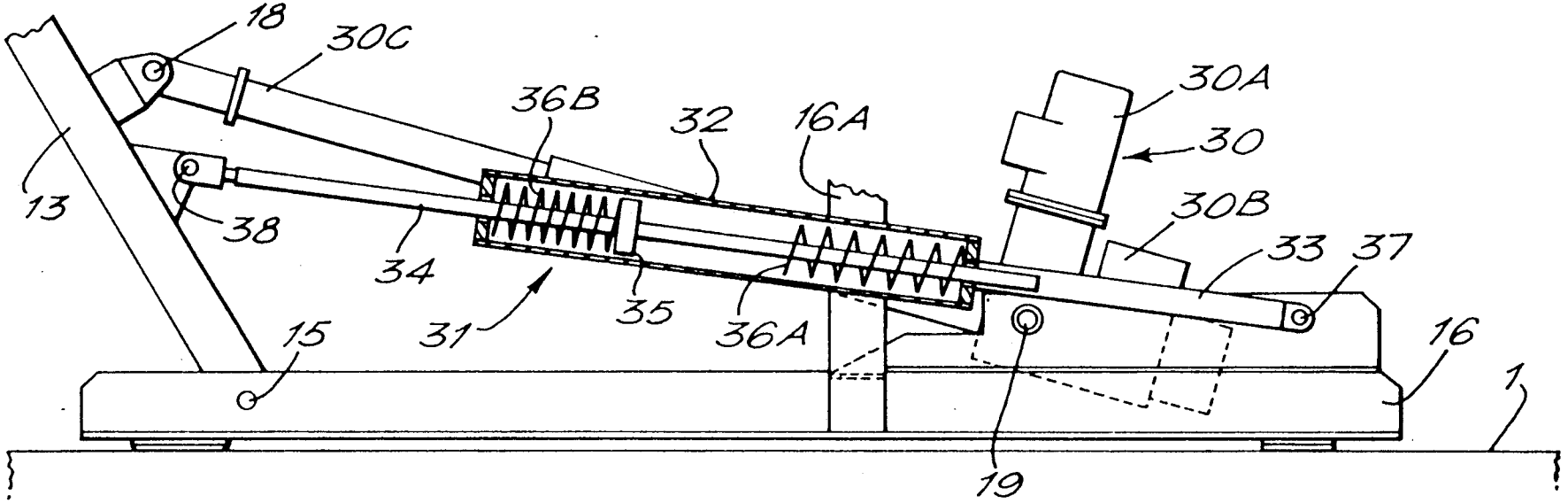
FIG. 3 is a side view of a modified form of device.

As shown in FIG. 1, the device is mounted on a floor 1, adjacent a vessel 2 containing a body of liquid 3 on which there is floating foreign matter 4. The device is required to remove this foreign matter 4 from the liquid 3, lift it over a lip of the vessel 2 and deposit the foreign matter 4 in the container 5.

The device includes a scoop 6 attached to a shaft 7 that is supported within a substantially horizontal arm 8. The shaft 7 is rotatably mounted in the arm 8 by a bearing assembly 9. At the rear of the arm 8, that is remote from the vessel 2, there is attached a motor gear box unit 10 which is connected to the shaft 7 for rotating the shaft 7 and with it the scoop 6.

At positions part way along the arm 8 two links 13, 14 are pivotally connected to the arm 8 at respective connections 11 and 12, these links 13 and 14 extending downwardly from the arm 8. At its lower end the link 13 is pivotally connected at 15 to a base 16 that is fixed to the floor. At its lower end the link 14 is pivotally connected at 17 to a telescopically extendable upright 16A of the base 16. The connection at 17 is thus adjustable in a vertical direction and can be set fast at any desired position within the range of adjustment provided. The four connections 11, 12, 15 and 17 are at the four corners of a quadrilateral.

A linear actuator piston and cylinder arrangement 20 is pivotally connected between a point 18 on the link 13 and a point 19 on the upright 16A of the base 16. Extension and retraction of the linear actuator 20 causes the link 13 to swing to and fro between the position shown in full lines and the position shown in dotted lines 21 in FIG. 1. The link 14 is shorter than the link 13 such that as the link 13 is thus swung the scoop 6 is maintained at a near constant height as it transverses the liquid surface.

As shown in FIG. 2, the scoop 6 is in the form of a quarter sector of a cylinder. One end face 22 is open and one radial face 23 is open. The other radial face 24 is provided with holes.

In operation, with the arm 8 withdrawn (link 13 at dotted line 21 position), the motor gear box unit 10 is run to rotate the scoop 6 until the arcuate face 25 is uppermost. The arm 8 is then moved over the liquid 3 until it is fully extended (link 13 in full line position) and then the scoop 6 is rotated through 180 degrees so that the edge 26 dips beneath the foreign matter 4. Next the arm 8 is withdrawn until the scoop 6 is close to the side of the vessel 2 and the arm 8 is then held stationary while the scoop 6 is rotated so that the foreign matter 4 is lifted clear of the surface of the liquid 3 and the scoop 6 moves clear of the vessel 2. Liquid drains through the holes in the face 24 an the arm 8 is then further withdrawn until the scoop 6 is positioned above the container 5. The scoop 6 is rotated in the reverse direction thus discharging the foreign matter 4 into the container 5.

The height of the scoop 6, relative to the liquid surface, is set by means of the vertically adjustable pivot connection at 17 within a range for the arm 8 in which the arm 8 is horizontal or very close to horizontal in its fully withdrawn and fully extended positions, and no more than 8° inclined to the horizontal in its most inclined position, so that the arm 8 is always substantially horizontal. In addition to the telescopically extendable upright 16A, the arm 14 can be constructed as a telescopically extendable member.

It will be appreciated that as the link 14 is shorter than the link 13 the travel of the scoop 6 across the surface of the liquid, although undulating, is nevertheless substantially planar.

In the modified form of FIG. 3, in place of the piston and cylinder arrangement 20 there is utilized an electrically driven unit 30 comprising a motor 30A, gear box 30B and screw jack 30C, the jack 30C being connected to the link 13 at the pivot point 18 and the motor and gear box being pivotally mounted at the pivot point 19. As shown in FIG. 3 the device is also fitted with a compensator arrangement 31 that reduces the force that has to be exerted by the unit 30 by compensating for the effect of gravity. The compensator arrangement 31 comprises a pair of spring units disposed one on each side of the motor 30A/gear box 30B/screw jack 30C. Each spring unit comprises a cylinder 32 carried by a hollow rod 33 that is fast with one end of the cylinder.

A further rod 34 entered through the other end of the cylinder 32 is telescopically engaged in the hollow rod 33 and carries within the cylinder 32 a piston 35. On either side of the piston 35 within the cylinder there is a spiral spring 36A or 36B. The rod 33 is connected to the base 16 at a pivot point 37. The rod 34 is connected to the link 13 at a pivot point 38. At mid-stroke the piston 35 holds each of the springs 36A, 36B lightly compressed. As the link 13 is pivoted by operation of the unit 30 to one side or the other of its mid-way position, the piston 35 moves progressively to increase the compression of one or other of the springs 36A, 36B, the compressing spring opposing the effect of gravity on the link 13.

It will be appreciated that a compensator arrangement as just described can also be provided in the device as described with reference to FIG. 1, associated with the actuator 20.

While preferred embodiments of the invention have been illustrated and described, it will be understood that changes and modifications may be made therein without departing from the invention in its broader aspects. Various features of the invention are defined in the following claims.

I claim:

1. A device for removing material from the free surface of a contained body of liquid, the device comprising a scoop supported from a base member by a first long length link and a second relatively shorter length link that carry a substantially horizontal elongated arm on which the scoop is mounted in such manner that the scoop rotatable about the direction of elongation of the arm, said first and second links solely supporting the arm, there being pivotal connections of each end of each link to the base member and to the arm, respectively, defining four corners of a quadrilateral; first actuating means connected to one of the links at its connection to the one base member to reciprocate the link and the arm so that the one arm thereby moves substantially in a horizontal plane defined by the unequal lengths of the two links; and second actuating means for rotating the scoop about the direction of elongation of the arm.

2. A device as claimed in claim 1, wherein the connection of the short link to the base member is by means of a vertically adjustable pivot connection.

3. A device as claimed in claim 1, wherein the scoop is secured to a shaft that extends through, and is rotatably mounted in, the arm; and wherein the second actuating means is connected for rotating this shaft.

4. A device as claimed in claim 1, wherein the first actuator means is a piston and cylinder arrangement pivotally connected between said one of the links and the base member.

5. A device as claimed in claim 1, wherein the first actuating means is a motor driven screw jack unit pivotally connected between said one of the links and the base member.

6. A device as claimed in claim 1, further including compensator means operatively connected to said one of the links for compensating for the effect of gravity when the first actuating means is activated for reciprocating said one of the links.

7. A device as claimed in claim 6, wherein the compensator means comprises springs arranged to oppose movement of said one link when said arm is reciprocated between a fully withdrawn and fully extended horizontal positions.

8. A device as claimed in claim 1, wherein said scoop includes a perforated face.

9. A device as claimed in claim 1, wherein said scoop is in the form of a quarter sector of a cylinder having one open end face, one closed end face, one open radial face, and one radial face containing holes.

10. A device as claimed in claim 1, wherein said scoop is mounted on a shaft supported within said arm.

11. A device for removing material from the free surface of a contained body of liquid, the device comprising a scoop supported from a base member by a first long length link and a second relatively shorter length link that carry a substantially horizontal elongated arm on which the scoop is mounted in such manner that the scoop is rotatable about the direction of elongation of the arm, said first and second links solely supporting said arm, there being pivotal connections of each end of each link to the base member and to the arm, respectively, defining the four corners of a quadrilateral; first actuating means connected to one of the links at its connection to the base member to reciprocate the one link and the arm so that the arm thereby moves substantially in a horizontal plane defined by the unequal lengths of the two links; second actuating means for rotating the scoop about the direction of elongation of the arm, and a compensator means comprising springs arranged to oppose movement of said first link for compensating for the effect of gravity when the first actuating means is activated for reciprocating said one link.

* * * * *